US011831065B2

(12) United States Patent
Kolokotronis

(10) Patent No.: US 11,831,065 B2
(45) Date of Patent: Nov. 28, 2023

(54) ANTENNA SUPPORT SYSTEM AND METHOD OF INSTALLING THE SAME

(71) Applicant: Dimitris Kolokotronis, Athens (GR)

(72) Inventor: Dimitris Kolokotronis, Athens (GR)

( * ) Notice: Subject to any disclaimer, the term of this patent is extended or adjusted under 35 U.S.C. 154(b) by 188 days.

(21) Appl. No.: 16/653,163

(22) Filed: Oct. 15, 2019

(65) Prior Publication Data

US 2021/0111474 A1 Apr. 15, 2021

(51) Int. Cl.
*H01Q 1/12* (2006.01)
*H01Q 3/08* (2006.01)

(52) U.S. Cl.
CPC ..... *H01Q 1/125* (2013.01); *H01Q 3/08* (2013.01)

(58) Field of Classification Search
CPC ..... H01Q 1/1228; H01Q 1/1242; H01Q 3/08; H01Q 1/246; H01Q 1/12; F16M 2200/022
See application file for complete search history.

(56) References Cited

U.S. PATENT DOCUMENTS

| | | | | |
|---|---|---|---|---|
| 2,415,103 | A | 2/1947 | Langstroth | |
| 3,505,890 | A | 4/1970 | Peterson | |
| 7,084,834 | B1 * | 8/2006 | Hopkins | H01Q 1/1228 343/878 |
| 9,437,918 | B1 | 9/2016 | Bales et al. | |
| 2010/0025559 | A1 * | 2/2010 | Rathbone | H01Q 1/1228 411/383 |
| 2010/0225802 | A1 | 9/2010 | Yamamoto | |
| 2014/0048660 | A1 * | 2/2014 | Lettkeman | F16B 2/065 248/201 |
| 2014/0218249 | A1 * | 8/2014 | Kolokotronis | H01Q 1/246 343/765 |
| 2018/0159199 | A1 * | 6/2018 | Kolokotronis | H01Q 1/246 |
| 2018/0166765 | A1 * | 6/2018 | Britz | H01Q 1/2291 |
| 2020/0365985 | A1 * | 11/2020 | Clifford | H01Q 3/08 |

FOREIGN PATENT DOCUMENTS

| | | | | |
|---|---|---|---|---|
| CN | 202616412 | U | 12/2012 | |
| EP | 2532901 | A1 | 12/2012 | |
| WO | 2013171291 | A2 | 11/2013 | |
| WO | WO-2013171291 | A2 * | 11/2013 | H01Q 3/005 |
| WO | 2017174113 | A1 | 10/2017 | |
| WO | WO-2019110697 | A1 * | 6/2019 | H01Q 1/1242 |

OTHER PUBLICATIONS

International Searching Authority, International Search Report, PCT Application Serial No. PCT/EP2018/083707, dated Mar. 27, 2019.
International Searching Authority, Written Opinion of the International Searching Authority, PCT Application Serial No. PCT/EP2018/083707, dated Mar. 27, 2019.

* cited by examiner

*Primary Examiner* — Ricardo I Magallanes
(74) *Attorney, Agent, or Firm* — Reichel Stohry Dean LLP; Natalie J. Dean

(57) ABSTRACT

Systems and methods of modifying an existing antenna base station are provided. Such methods may comprise the steps of replacing legacy antenna support brackets (10) with a new mast clamp arrangement (200) coupled with a steering and locking unit (100).

21 Claims, 13 Drawing Sheets

ANTENNA SUPPORT SYSTEM AND METHOD OF INSTALLING THE SAME

BACKGROUND

The present disclosure relates to an improved antenna support system and method of installing the same. More specifically, the present disclosure is concerned with a system and method well suited to mounting modern cellular antennas to masts.

By 'modern' cellular antennas we mean 5G technology and beyond, MIMO and massive-MIMO, multi-band, multi-beam, multi-directional, active or passive antennas.

DESCRIPTION OF RELATED ART

Since the early days of mobile communication technology back in the 1990's, directional cellular antennas on towers and masts, have been installed using the same principle. The antennas had to be placed high from the ground in order to reduce the RF path-loss effects (or RF signal attenuation). The antennas also need to point in specific directions in the horizontal plane (i.e. at an azimuth angle about a vertical axis-alignment of the antenna directionality with respect to North) and in the vertical plane (i.e. tilt angle about an horizontal axis-alignment of the antenna directionality with respect to the earth's centre of gravity) in order to satisfy certain RF planning criteria for optimum coverage, capacity and quality of wireless communications.

In order to install antennas at a specified height from the ground, mobile communication networks worldwide adopted the engineering and design of very well-known tower and mast types such as lattice and pole systems. The terms "mast" and "tower" are often used interchangeably, and it is to be understood that the term "mast" is used in this application to cover both masts and towers. However, it will be noted that in structural engineering terms, a tower is a self-supporting or cantilevered structure, while a mast is held up by stays or guys.

The self-supported lattice is the most widespread form of construction. It provides high strength, low weight and low wind resistance, and is economic in its use of materials. Lattices of triangular cross-section are most common, and square lattices are also widely used. Guyed lattice masts are also often used; the supporting guy lines carry lateral forces such as wind loads, allowing the mast to be very narrow and of modular construction. The entire structure is constructed by creating a series of horizontal ladders, or internal triangular structures, that secure the tower's three, or four base legs. Guyed masts are also constructed out of steel tubes.

Last but not least, monopole rooftop masts (which may be covered with camouflage and/or a radome) have been installed on top of many buildings. With the advent of urban mobile communications, developers wanted a more efficient way to construct and operate low-height elevation systems for aesthetic reasons. They conceived the idea of the monopole rooftop configuration, a lattice mast with a pole on top used for antenna mounting. These configurations became more fashionable, once alternative construction materials began to exhibit greater strength and flexibility without failing. Today these free-standing masts are fabricated from various materials.

In order to install on towers and masts the antennas at specified direction with respect to North (azimuth alignment) and the earth's centre of gravity (tilt alignment), the industry adopted the engineering and design of antenna azimuth and tilt mounting brackets.

The antenna tilt bracket is a standard antenna accessory, delivered with the specific antenna purchased, and as such we will not further describe the various types of tilt bracket here. The most common type of antenna azimuth bracket in the field comprises a set of collars that are mounted on one side at the antenna tilt bracket and on the other side are fixed on a pole. Azimuth alignment is performed by loosening the collars, aligning the antenna and tightening the collars on the pole. More sophisticated antenna azimuth brackets are described in detail in the applicant's related co-pending International Patent Application No. PCT/EP2018/083707, filed Dec. 5, 2018, and published as WO2019/110697, the content of which is incorporated by reference herein in its entirety.

Radio coverage of each antenna needs to be decided according to radio planning criteria.

On a typical 3-sector site, each directional antenna needs to be capable of 120 degrees azimuth and 20 degrees tilt range (10 degrees up-tilt and 10 degrees down-tilt). Even fully equipped with both azimuth and tilt brackets, an antenna cannot be directly installed on the mast structure and still be capable of full movement in both azimuth and tilt directions. The main reason for that is the fact that modern cellular antenna geometry (panel type) are bulky, long (may reach up to 3 meters length), wide (may be more than half a meter wide) and heavy (may weigh more than 50 kgs); not to be mentioned that over a dozen coaxial cables are mounted on the bottom of the antenna that cannot be over-bended, especially when the antenna is to be down-tilted.

Using the well-known set of collars for performing azimuth steering and alignment, the antenna always needs to be mounted on a mast's structural member that is of circular shape, is capable of supporting the excessive weight and wind-load and of course has the required clearance from other antennas and the structure itself for azimuth alignment according to radio planning instructions. This should be the case for pole masts, as poles are of circular shape and their main structural member is the pole itself, however, taking into account that usually 3 antennas (for a 3-sector site), half a meter wide and with azimuth range freedom of 120 degrees each are to be installed on the pole's top, the pole should have more than 1 meter diameter in order to perform. Using such poles for the purpose, is not only expensive but also impractical (most of the times impossible) to implement. The situation is complicated further when the pole is to be supported by wires.

For the lattice mast types (guyed or self-supported), the same or more problems are to be tackled.

Lattices of either triangular or rectangular cross-section may have 3 or 4 vertical upright structural members (of various shapes such as equal angles, hollows and the like) that are mounted together with multiple horizontal and diagonal cross-members, spaced apart in sets (the number of which determines the mast height), so as forming the desired lattice mast configuration.

Considering the known requirements for antenna mounting:

a) The antenna needs to be tightly secured, collinearly on a vertical structural member, otherwise the antenna reflector/backplane will twist. Geometric deformation of the antenna's reflector impacts its radiation performance, which is undesirable.

b) The antenna needs to be tightly secured with a baseline orientation perpendicular to the ground, otherwise both tilt and roll antenna dimensions will be offset from the global reference plane, which is the earth's centre of gravity.

c) The mast vertical structural members have limited available surface area for antenna mounting because the horizontal and diagonal cross-members are fixed to them in close patterns, and cannot be removed. The situation is further complicated when the lattice mast is to be supported by wires.

d) The antenna's vertical spacing of its top and bottom mounting points are fixed in position, which makes it very likely to coincide with the horizontal and diagonal cross-member mounting points on the mast vertical structural members. The situation is further complicated when the lattice mast is to be supported by wires.

e) The vertical members the antennas are attached to always need to have circular shape when using the well-known set of collars for performing antenna azimuth steering and alignment. This is not the case for the majority of lattice mast configurations.

f) An antenna of around three meter length and half a meter width needs to be placed spaced apart from the mast section on the horizontal plane in order to achieve azimuth steering of 120° range and tilt inclination of 20° range (up-tilt or down-tilt) without clashing on the mast structural members.

Having all these requirements in mind, the industry adopted the engineering and design of a universal antenna "support system" that could be installed without implementation problems on both pole and lattice masts while being capable for antenna azimuth and tilt alignment in order to satisfy both the structural engineering requirements and the radio planning instructions.

An example of a legacy antenna "support system" adopted by the industry is shown in FIG. 1.

Referring to FIG. 1 there is shown a cellular antenna mast 2 comprising vertical upright members 4, horizontal cross-members 6 and bracing members 8. The mast 2 is a square-section lattice mast. For the purposes of the present disclosure, a "mast member" is a component that is part of the mast. In other words, it is structurally integrated with the mast to the extent that removal would cause structural problems. "Mast members" include monopole rooftop masts installed on buildings, possibly on top of a lattice structure, but not e.g. poles attached to the side of an existing mast (as with legacy systems).

The support system 10 comprises a pair of pole supports 12, 14. Each support 12, 14 comprises a pair of elongate metal tubes 16, 18 attached at a first end to the mast (specifically the upright members 4) and a pole clamp 20 at a second end. The supports 12, 14 are attached to the mast at two spaced-apart vertical positions. An antenna pole 22 is inserted through the pole clamps of both supports, and defines an azimuth steering axis Z.

As well as supporting the weight of the antenna, the support system 10 is configured to allow the riggers to install the antenna at the desired azimuth and tilt direction. Antenna tilt brackets 26, 28 are installed each on pole 22. The antenna tilt brackets comprise collars 27, 29 that clamp the pole 22 and permit selective rotation about the steering axis Z. The collars 27, 29 of the mechanical tilt brackets can be tightened to inhibit antenna rotation about the azimuth steering axis. The mechanical tilt brackets 26, 28 also rotate the antenna in the vertical plane (inclination).

In this way, the industry adopted the engineering and design of a universal antenna "support system" that could be installed without implementation problems on both pole and lattice masts while being capable for antenna azimuth and tilt alignment in order to satisfy both the structural engineering requirements and the radio planning instructions.

However, there are several problems with this approach.

Firstly, the antenna supports 12, 14 and pole 22 are all machined hot-dipped galvanized steel that add considerable weight and wind-load to the mast and specifically at the tower-top. A typical legacy antenna support system weights 60 kg (i.e. for a typical 3 sector installation 180 kgs in total) while it adds an unnecessary (considerable compared to the antenna) effective projected area (EPA) to the antenna system. Considering the dynamic and static stresses that are applied to the mast base legs, the extra weight negatively impacts the mean time between failure (MTBF) of the tower itself—not to mention that on marginal static cases (especially when RAN technology network upgrades are needed), expensive mast reinforcements are also required.

Due to weight, the legacy antenna "support" also presents a negative environmental footprint (caused by the unnecessary galvanized steel deployed for antenna mounting). This unnecessary weight directly translates into increased $CO_2$ emissions into the environment. 5G technology itself is characterized by high energy consumption and there is a need for mobile network operators to reduce their environmental footprint.

Secondly, the legacy antenna "support" system installation is complex, as it needs to take place in three discrete phases:

1. The first phase requires the antenna "support" system to be installed on the mast's vertical upright members 4;
2. the second phase requires the antenna and its azimuth 27, 29 and tilt brackets 26, 28 to be installed on the antenna "support" (and specifically on pole 22); and,
3. the third phase requires the antenna azimuth and tilt alignment to be performed on the spot.

This is clearly undesirable due to the large amount of time it takes the riggers to perform such an installation. Longer times of specialized personnel (like riggers) on the tower-top, negatively impacts installation costs, revenues (increased site-down-time) and has health and safety at work implications.

Thirdly, although the main reason that the engineering and design of the legacy universal antenna "support" system is the antenna alignment capability it provides (azimuth and tilt), both azimuth and tilt alignment is performed at tower-top with unknown accuracy and precision. Antenna azimuth and tilt alignment is still performed with the use of collars 27, 29 and the tilt bracket 26, 28 which are not calibrated for azimuth and tilt steering (thus presenting systematic errors), operated by a person (rigger) that also adds random errors in the alignment process on top of the systematic errors. Any deviation between the actual vs the instructed antenna positioning on the mast is clearly undesirable as it may impact coverage, capacity and quality of cell-site wireless connections.

Due to the weight and wind-load issues, the longer times required to perform the installation as well as the azimuth and tilt alignment unknown errors caused by the legacy antenna "support" installation process, this solution presents an unjustified high total cost of ownership (TCO). Analysing the actual TCO of the legacy solution, we may sum-up the following:

a) increased costs for site installation (longer rigging time on tower-top);

b) increased costs for site reinforcements (higher dynamic and static stresses);

c) reduced revenues due to high site-down-time (longer rigging time on tower-top);
d) reduced revenues due to erroneous antenna alignment (resulting in degraded coverage, capacity and quality of cell-site wireless connections);
e) increased logistics cost (higher warehousing and transportation needs);
f) increased costs due to decreased depreciation of towers and masts (lesser MTBF); and,
g) increased manufacturing costs (more material, machining and waste).

From total cost of ownership (TCO) perspective it is desirable to improve some or all of the above.

From a structural perspective it is desirable to:
a) minimise the dynamic stress and static load effect on the structural part due to excessive, unnecessary weight of legacy antenna mountings, at tower-top; and,
b) minimize the higher effective projective area (EPA) of the antenna system (antenna and antenna bracket) that causes increased wind loading on the tower.

This problem is clearly faced when additional antennas and tower-top equipment needs to be installed on existing masts, particularly for i.e. 5G technology upgrades.

From an environmental perspective it is desirable to:
a) minimise the utilization of unnecessary galvanized steel, where this directly translates into increased CO2 emissions to the environment.

From a radio planning perspective it is desirable to:
a) accurately align the installed antennas; and,
b) accurately re-align the antennas for optimization purposes.

From a health and safety perspective it is desirable to:
a) minimize tower-top working hours for rigging and climbing crews when installing the antennas; and,
b) minimize tower-top working hours for rigging and climbing crews when aligning the antennas.

The aim of the present disclosure is to facilitate a quick and easy, lightweight, safer, environmentally friendly mounting of generally heavy and aerodynamically inefficient modern cellular antennas at the top of masts, whilst providing the same or greater functionality as legacy systems.

A prior antenna mounting bracket is disclosed in U.S. Pat. No. 9,437,918. US'918 discloses a bracket with adjustable azimuth settings coupled to a "support structure". The bracket has a pivot rod about which a moveable bracket assembly is rotatable via a gearbox. The moveable bracket assembly can be locked with locking pins. The document discloses that the backplate of the bracket may be attached to a platform associated with a base station tower. The need for such a "platform" (akin to the support structure of the prior art) and the provision of a single bracket that spans the entire height of the antenna demonstrates that this particular device exhibits all of the aforementioned problems with the prior art.

BRIEF SUMMARY

According to a first aspect of the present disclosure, there is an antenna support system comprising:

a universal clamp kit having:
a first and a second universal clamp plate;
a first set of components for adapting the universal clamp plates to form a first clamp to clamp a first shape of antenna mast section; and,
a second set of components for adapting the universal clamp plates to form a second clamp to clamp a second shape of antenna mast section; and,
an azimuth steering unit configured to attachment to the first universal clamp plate.

Advantageously, the provision of a mast clamp and steering and locking unit allows the antenna to be placed closer to the mast itself, reducing the wind loading moment. Furthermore, the use of a clamp and steering unit is less bulky and heavy than the prior art support bracket and pole arrangement.

Preferably the first and second shapes of antenna mast section are selected from: a square section, a planar section, an angle section and a circular section.

Preferably at least the first clamp engages with the first shape of antenna mast section such that the first clamp cannot be rotated relative to the first shape of antenna mast section.

Preferably the first universal clamp plate is attachable to a wall.

Preferably azimuth steering unit comprises a housing containing a rotational joint. The rotational joint may comprise a rolling element bearing or bushing. The azimuth steering unit preferably comprises a locking mechanism configured to mechanically lock the steering unit at a predetermined angle. Preferably the locking mechanism comprises a locking plate and a locking member engageable with the locking plate to thereby lock the steering unit. For example, the locking plate may comprise a plurality of openings or a ratchet and pawl mechanism to facilitate locking. Further, in at least one embodiment, the unit may be the same as or similar to the applicant's steering and locking unit disclosed in WO2013/171291 or WO 2019/110697.

Preferably the first and second clamps are configured to support an antenna by virtue of mechanical friction with the first or second shapes of mast sections respectively.

According to a second aspect there is provided a method of installing an antenna support system comprising the steps of:

providing a universal clamp kit having:
a first and a second universal clamp plate;
a first set of components for adapting the universal clamp plates to form a first clamp to clamp a first shape of antenna mast section; and,
a second set of components for adapting the universal clamp plates to form a second clamp to clamp a second shape of antenna mast section; and,
providing an azimuth steering unit;
selecting one of the first and second sets of components;
assembling the first or second clamp dependent upon the selected set of components;
attaching the azimuth steering unit to one of the first and second universal clamp plates;
clamping a mast member with the first or second clamp; and,
attaching a cellular antenna to the azimuth steering unit.

According to a third aspect there is provided a method of modifying an assembly of a mast and cellular antenna, the assembly comprising:

an antenna mast comprising a mast member;
a support bracket attached to the mast member at a first end, and to a pole at a second end;
a first antenna attached to the pole so as to be rotatable with respect to the pole in at least one of a vertical and horizontal axis;
the method comprising the steps of:

removing the support bracket and the antenna from the mast;

providing a mast clamp configured to clamp the mast member between at least a first and second part of the mast clamp;

providing an azimuth steering unit;

attaching the steering unit to the mast clamp;

clamping the mast member with the mast clamp; and attaching one of the first antenna and a second antenna to the steering and locking unit.

Preferably the method comprises the steps of:

assembling the one of the first antenna and a second antenna, azimuth steering unit and mast clamp before clamping the mast member with the mast clamp.

Preferably the method comprises the steps of:

locking the steering unit before clamping the mast member with the mast clamp.

Preferably the method comprises the steps of:

measuring the orientation of the mast member;

identifying a desired antenna heading;

calculating the required azimuth steering angle of the steering unit to achieve the desired antenna heading;

locking the steering unit at the required azimuth steering angle before clamping the mast member with the mast clamp.

Preferably the step of locking takes place before a step of elevating the antenna to the required height.

Preferably the assembly comprises two spaced-apart support brackets, and wherein the pole extends between the support brackets.

Preferably the method comprises:

providing two mast clamps;

providing two azimuth steering units, attached to respective mast clamps;

attaching the first or a second antenna to the mast at two spaced apart positions using the two mast clamps such that the azimuth steering axes of the steering units are aligned.

Advantageously, the symmetry of the steering unit fixing holes 120, along with the symmetry of the azimuth steering unit locking plate 104, ensures that the installed antenna will be tightly secured, collinearly on the mast's vertical structural member, as such the antenna reflector/backplane cannot be twisted when clamped on the mast.

In a preferred embodiment, the "reference frame" method described in the applicant's earlier application WO2013/171291 is combined with the present disclosure. The mast member forms the reference frame.

BRIEF DESCRIPTION OF THE SEVERAL VIEWS OF THE DRAWINGS

The disclosed embodiments and other features, advantages, and aspects of the example antenna mounting apparatuses contained herein, and the matter of attaining them, will become apparent in light of the following detailed description of various exemplary embodiments of the present disclosure. Such detailed description will be better understood when taken in conjunction with, and with reference to, the accompanying drawings in which.

Figure 1:
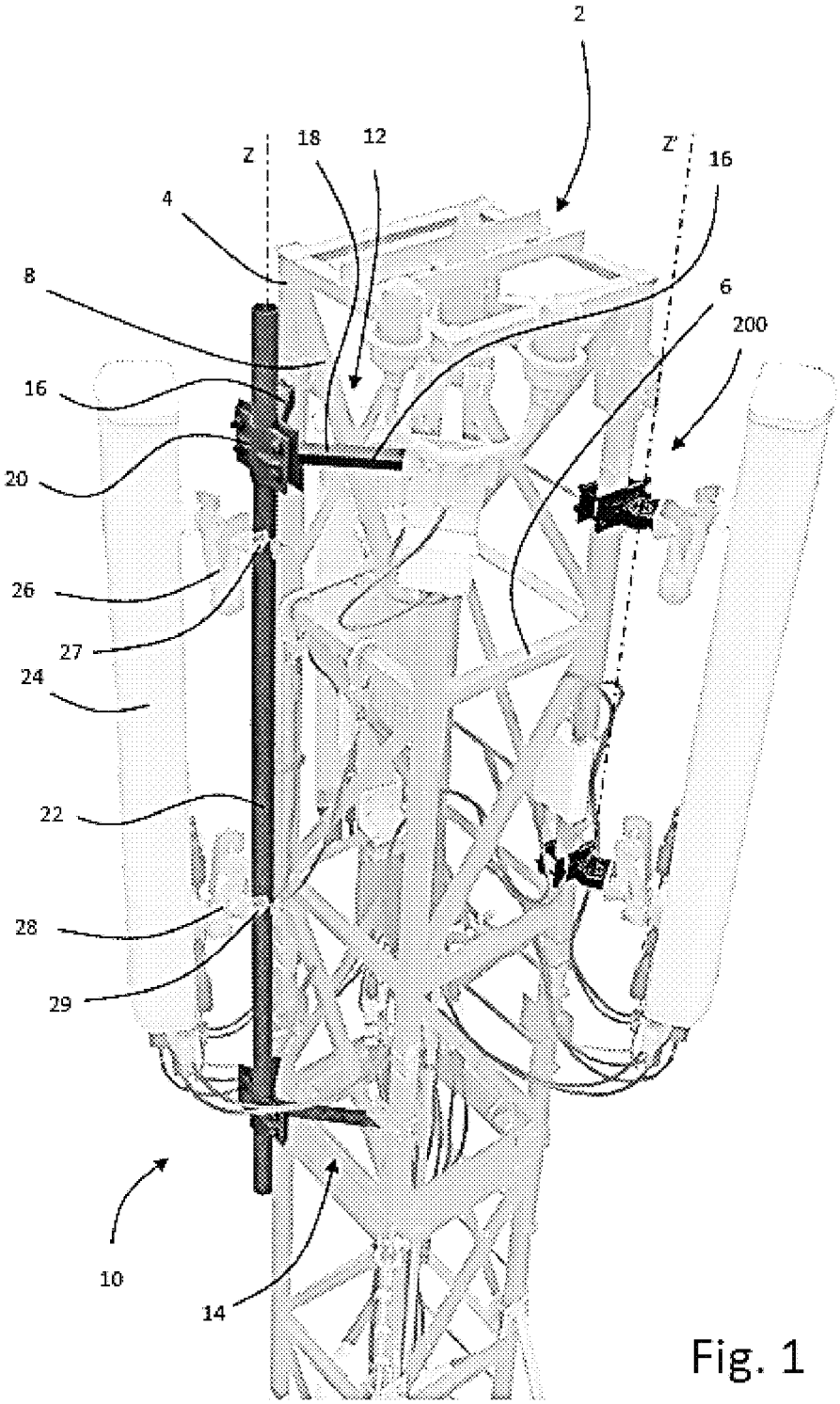
FIG. 1 is a perspective view of a prior art antenna mounting system and an antenna mounting system according to the disclosure on the same mast.

While the present disclosure is susceptible to various modifications and alternative forms, exemplary embodiments thereof are shown by way of example in the drawings and are herein described in detail.

DETAILED DESCRIPTION

Figure 2A:
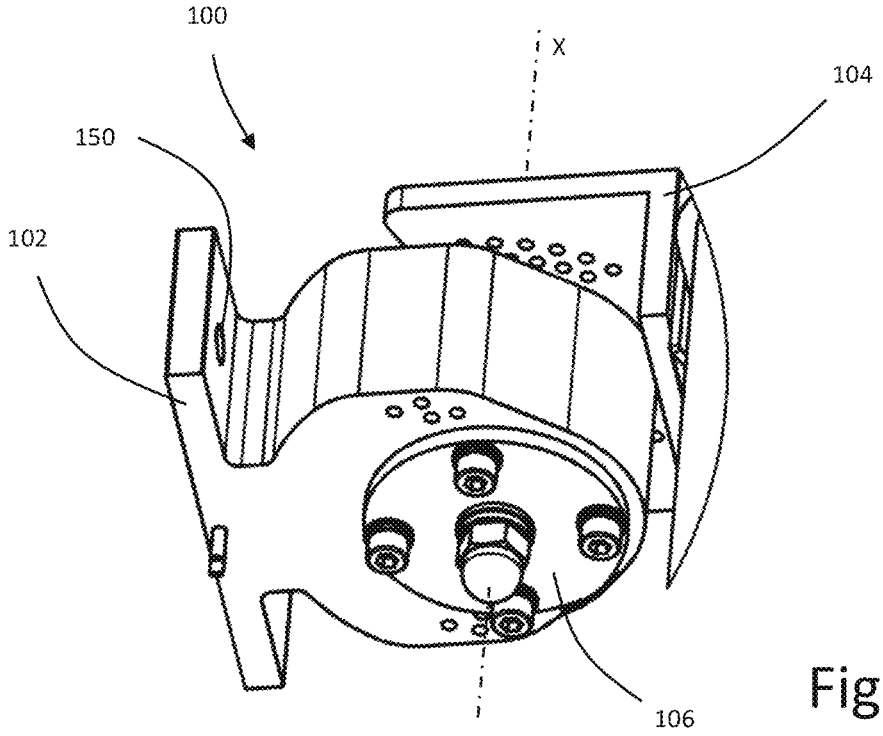
FIGS. 2*a* and 2*b* are perspective views of a steering and locking unit for use with systems and methods of the present disclosure.
Figure 2B:
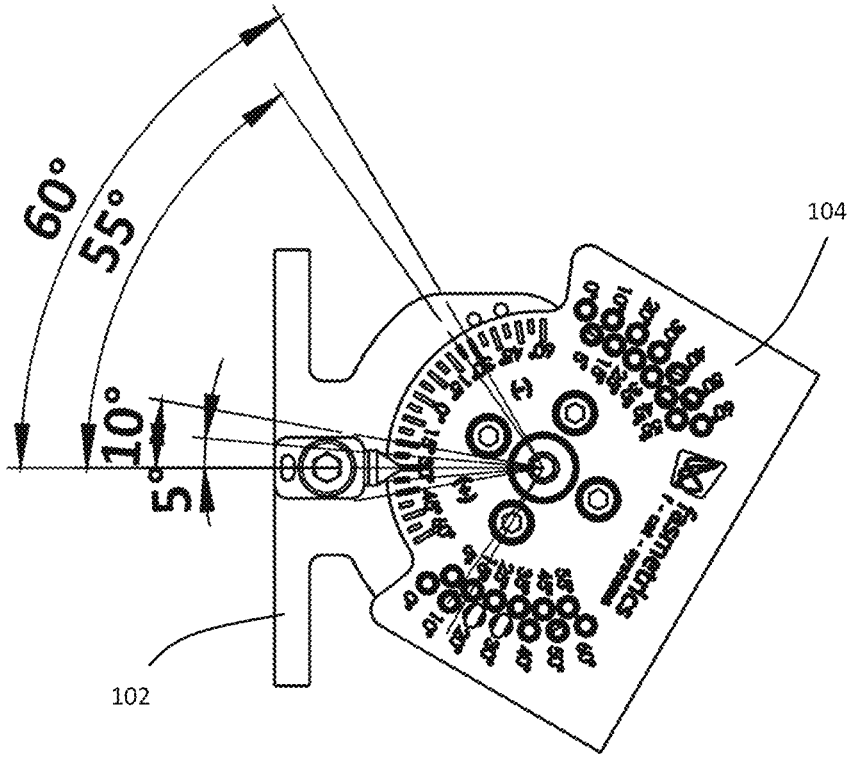

Referring to FIGS. 2*a* and 2*b*, a steering and locking unit 100 for use with the present disclosure is shown. The unit is described in detail in the applicant's co-pending application published as WO2019/110697, the content of which is incorporated by reference herein in its entirety. Broadly speaking, the unit 100 comprises a mast-side portion 102, an antenna-side portion and a rotational joint 106 therebetween enabling the two portions 102, 104 to be rotated relative to one another about an azimuth steering axis X. The mast-side portion has a pair of spaced-apart fixing holes 150. Each of the embodiments discussed below is concerned with mounting the steering and locking unit 100 such that azimuth steering and locking of the antenna relative to a fixed structure (e.g. a mast or wall) is possible.

Figure 7A:
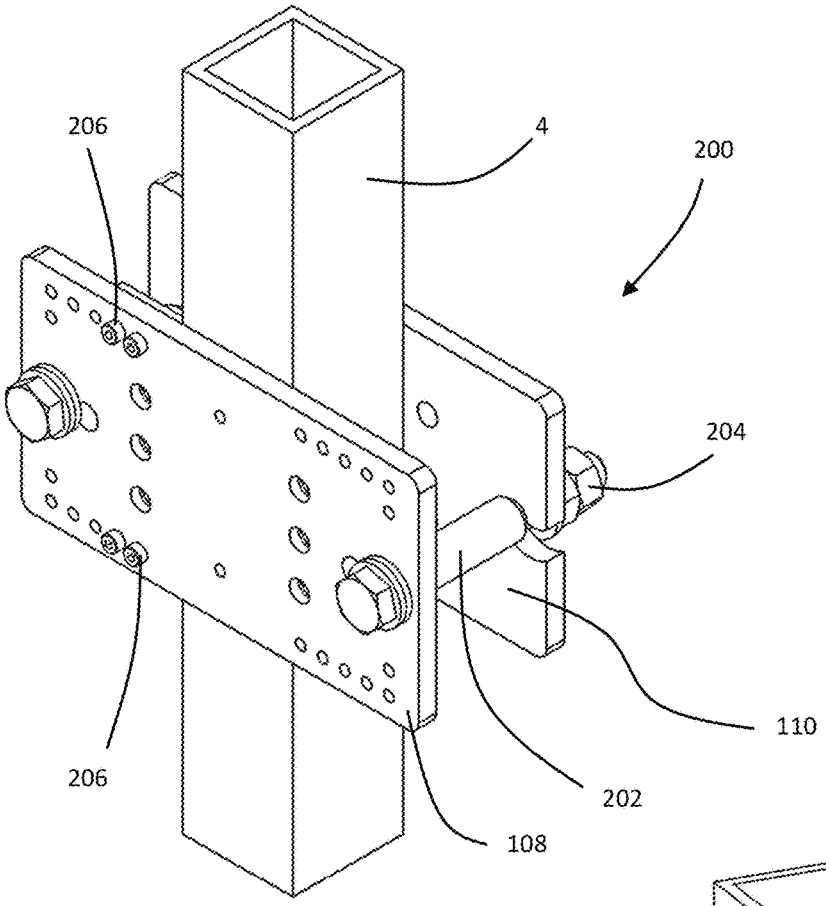
FIGS. 7*a* and 7*b* are perspective views of a first antenna mounting bracket in accordance with the present disclosure.
Figure 7B:
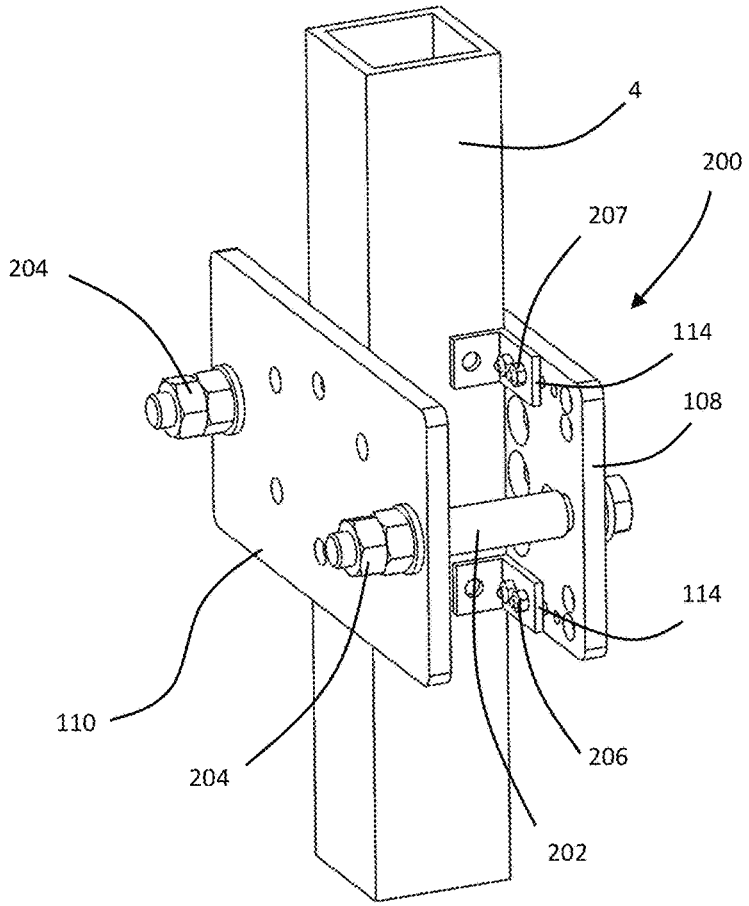
Figure 8A:
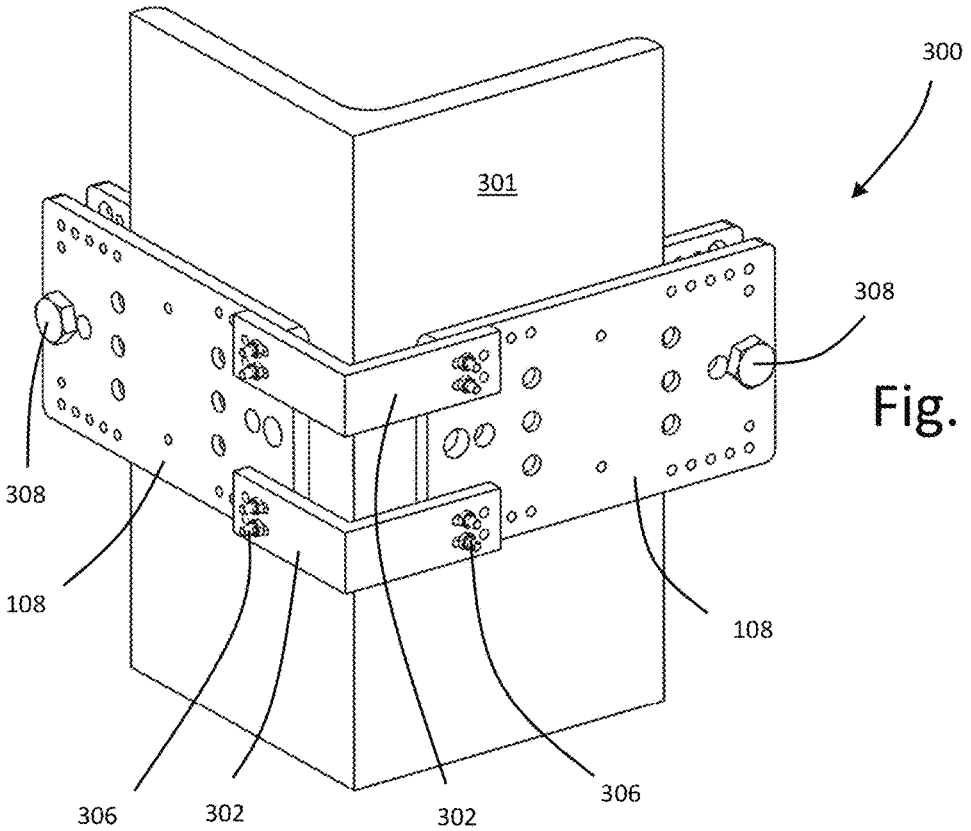
FIGS. 8*a* and 8*b* are perspective views of a second antenna mounting bracket in accordance with the present disclosure.
Figure 8B:
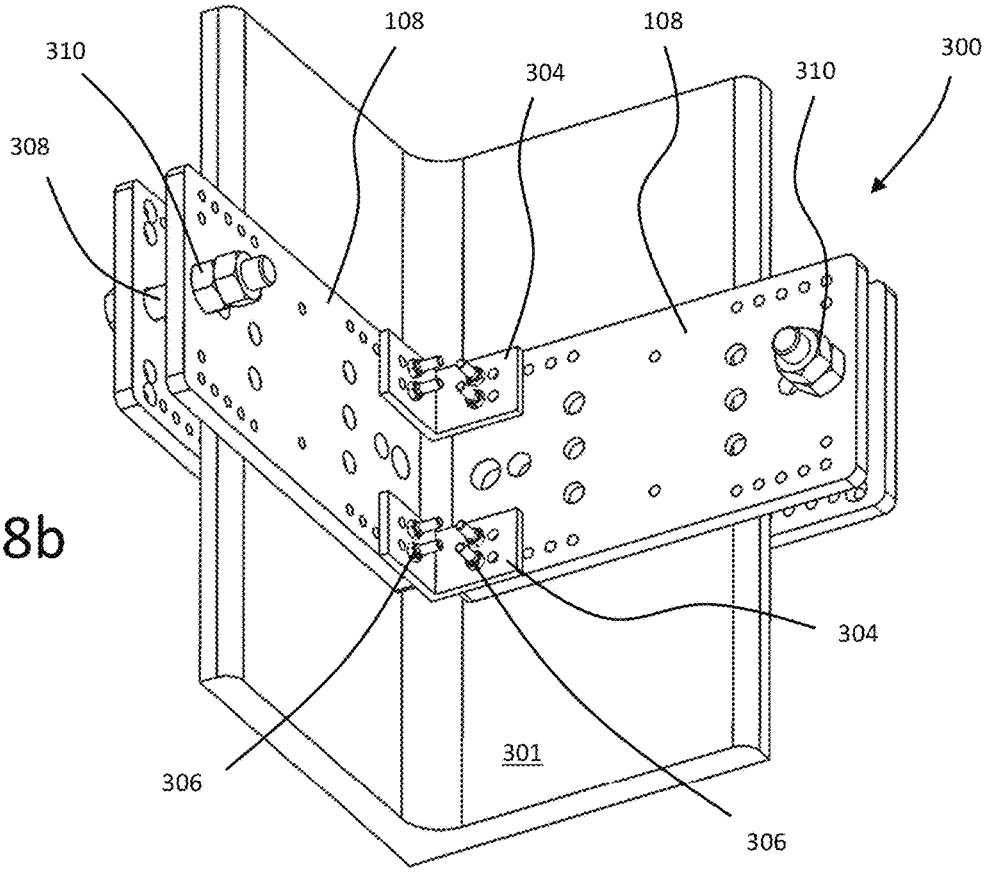
Figure 9A:
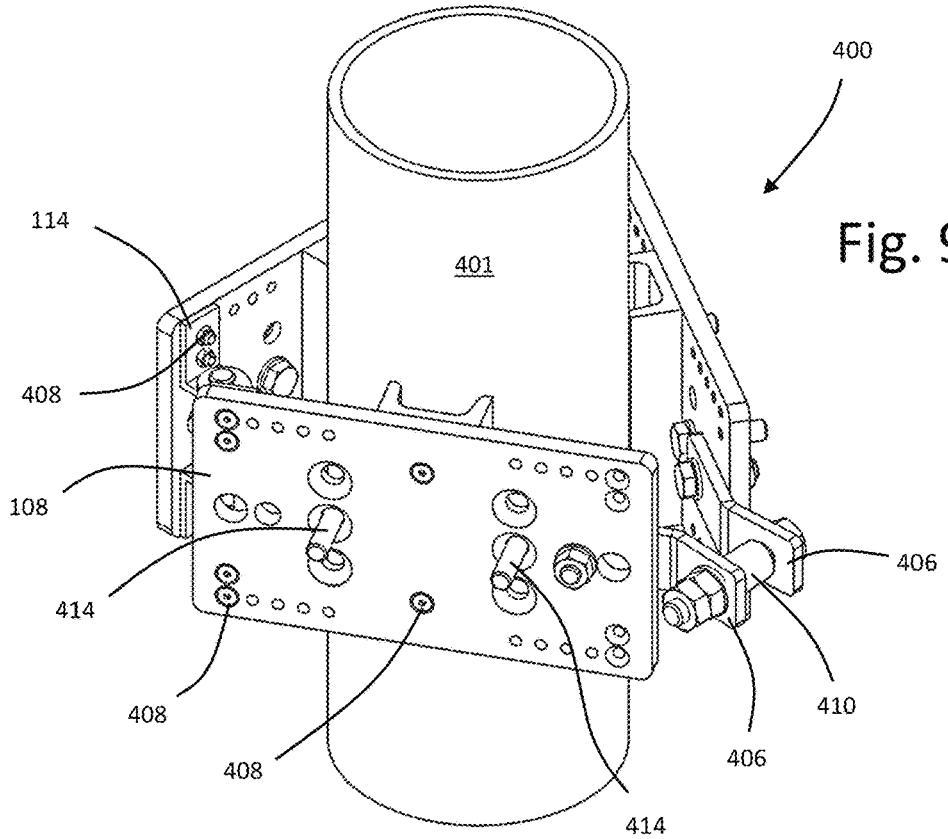
FIGS. 9*a* to 9*c* are perspective views of a third antenna mounting bracket in accordance with the present disclosure.
Figure 10A:
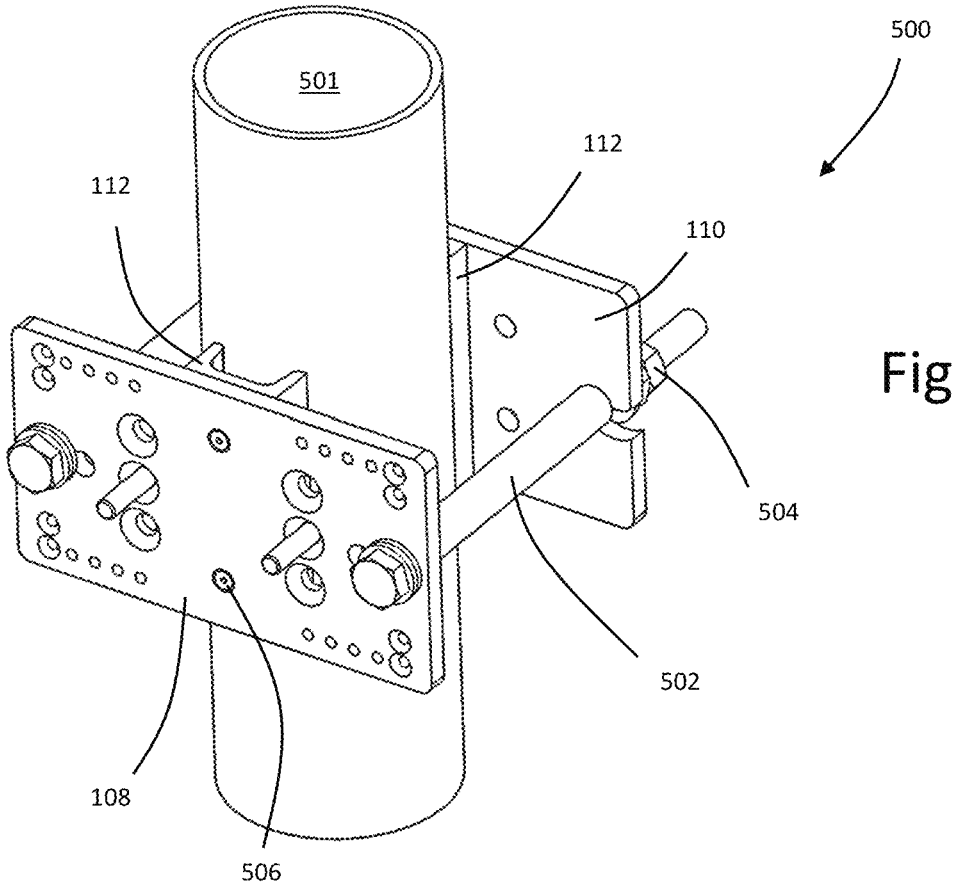
FIGS. 10*a*, 10*b*, and 10*c* are perspective views of a fourth antenna mounting bracket in accordance with the present disclosure.
Figure 10B:
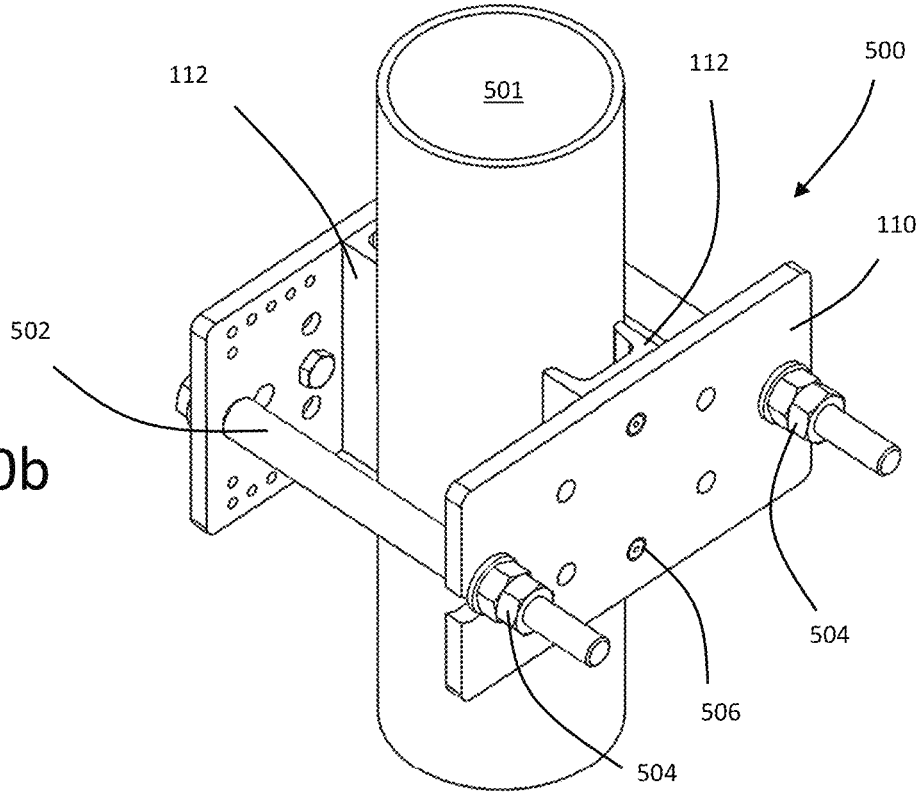
Figure 11A:
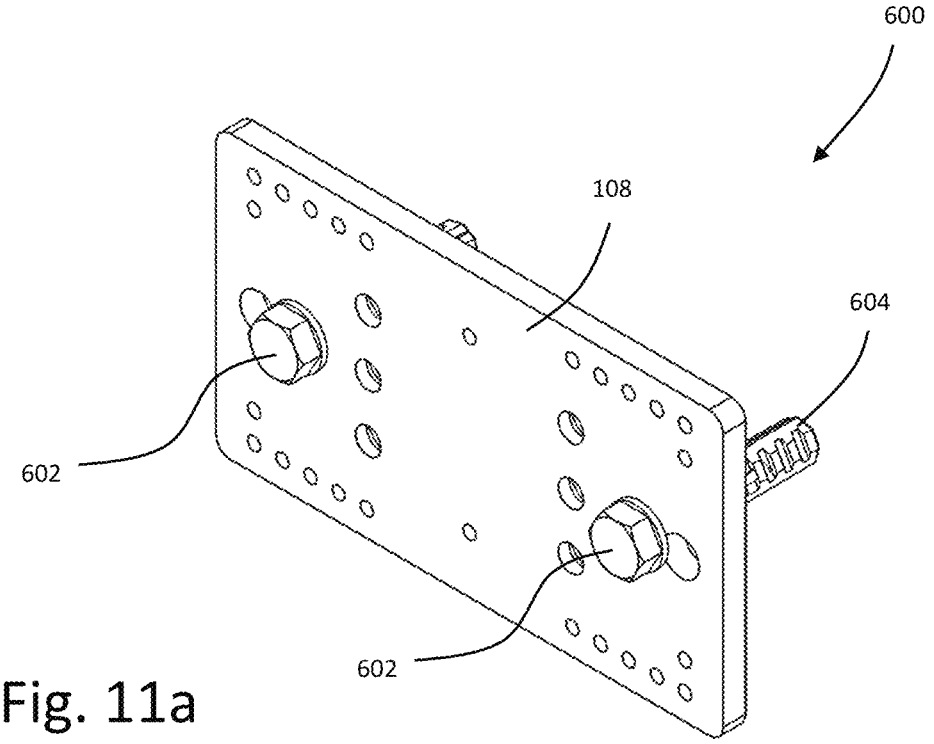
FIGS. 11*a* and 11*b* are perspective views of a fifth antenna mounting bracket in accordance with the present disclosure.
Figure 11B:
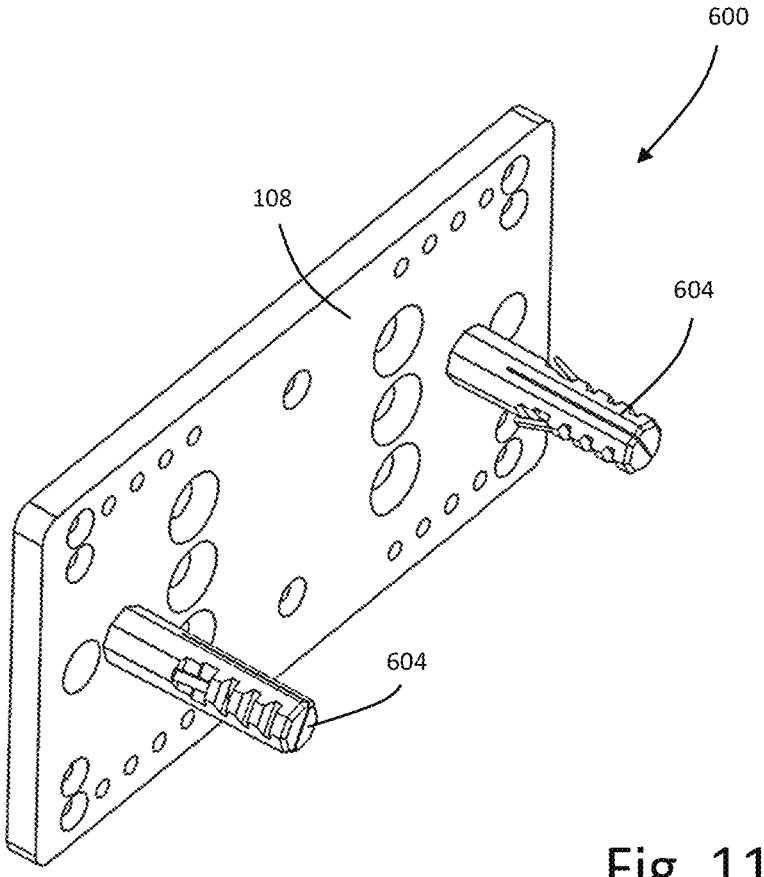

According to the present disclosure, there are five brackets for attaching the steering and locking unit 100 (and therefore an antenna) to a range of structures. The different types of brackets are:

H-type bracket 200—for attachment to square sections (FIGS. 7*a* and 7*b*);

E-type bracket 300—for attachment to angle sections (FIGS. 8*a* and 8*b*);

J-type bracket 400—for attachment to circular sections (FIGS. 9*a* and 8*b*);

P-type bracket 500—for attachment to circular sections (FIGS. 10*a* and 10*b*);

W-type bracket 600—for attachment to walls (FIGS. 11*a* and 11*b*).

The brackets form part of an antenna mounting kit or system, comprising various components common to one or more of the brackets. These components are:

Bracket plate 108—used in all types of bracket;

Back plate 110—used in types H, E, P;

Pole clamp plate 112—used in types J, P;

Angle section 114—used in types H, J.

Other components are used in each bracket type, but tend to be unique to that bracket. Therefore the kit or system is modular—the common parts of the kit can be combined in different ways to attach antennas to different types of structure.

Each bracket H, E, J, P is essentially an adaptor to clamp the relevant section of the structure and present a face for attachment of the steering and locking unit 100. The clamps do not rely on drilling holes or openings in the underlying structure (with the exception of the W-type bracket for walls).

Bracket Plate 108

Figure 3:
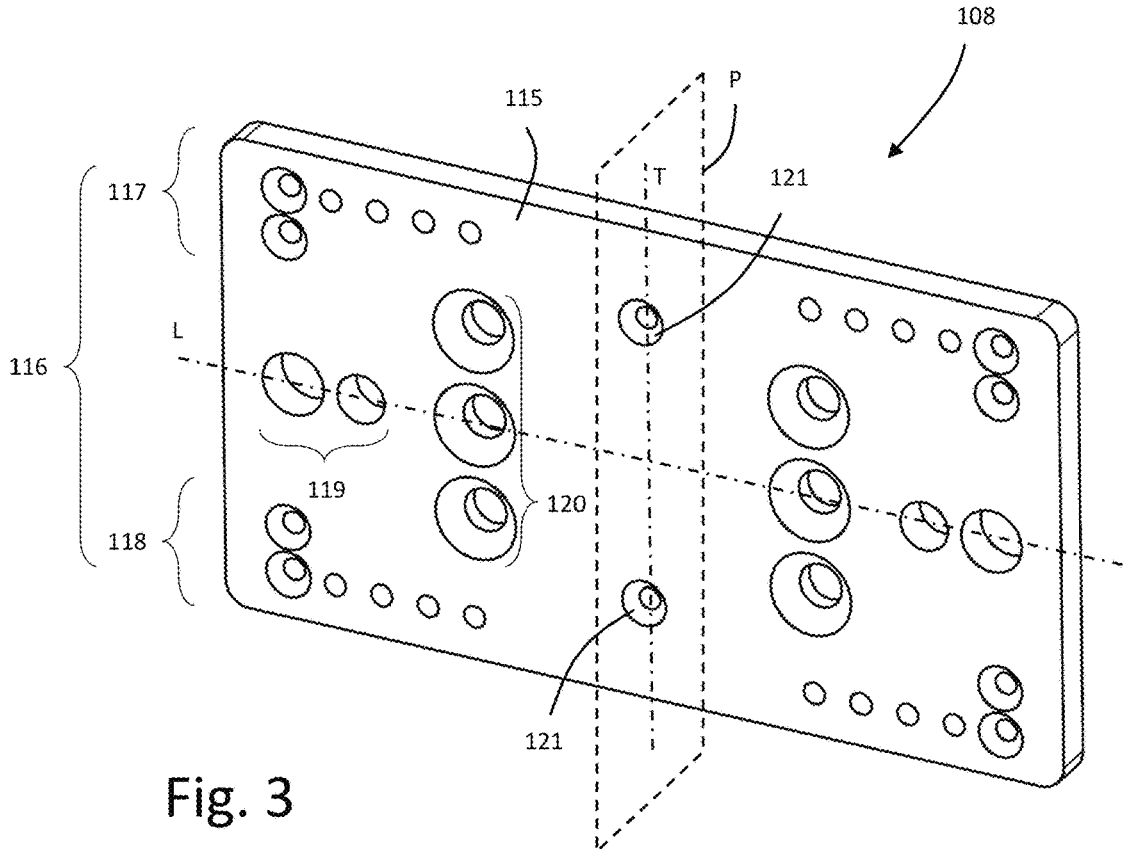
FIG. 3 is a first modular component in accordance with the present disclosure.

Referring to FIG. 3, the bracket plate 108 is a flat, rectangular plate 115 comprising a plurality of circular through-bores as described below.

The plate 108 is symmetrical about a plane of symmetry P, coincident with a transverse axis T and normal to a long axis L. Each side has a plurality of fixing holes 116 divided into a first set 117 and a second set 118. Each set 117, 118 is in an "L" shape nested in a corner of the plate 115. A pair of clamping holes 119 are provided on each side of the plate 108, aligned along the plate's long axis L. Three steering unit fixing holes 120 are provided in a line parallel to, and offset from the transverse axis T. A pair of pole clamp plate fixing holes 121 are provided spaced along the transverse axis T.

Back Plate 110

Figure 4:
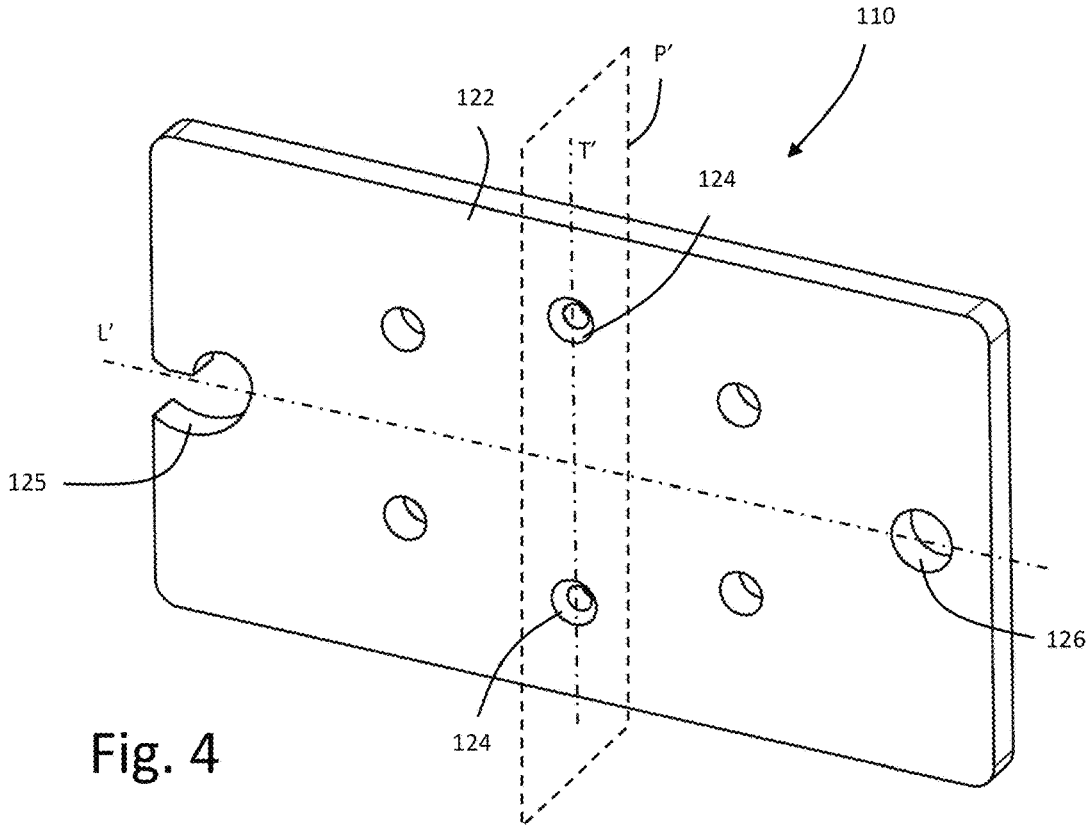
FIG. 4 is a second modular component in accordance with the present disclosure.

Referring to FIG. 4, the back plate 110 is a flat, rectangular plate 122. The plate is generally symmetrical about a plane of symmetry P', coincident with a transverse axis T' and normal to a long axis L'.

A pair of pole clamp plate fixing holes 124 are provided spaced along the transverse axis T.

On one side of the plate 110, a curved open slot 125 is provided, extending from the periphery. On the opposite side a clamping hole 126 is provided.

Pole or Circular Section Clamp Plate 112

Figure 5:
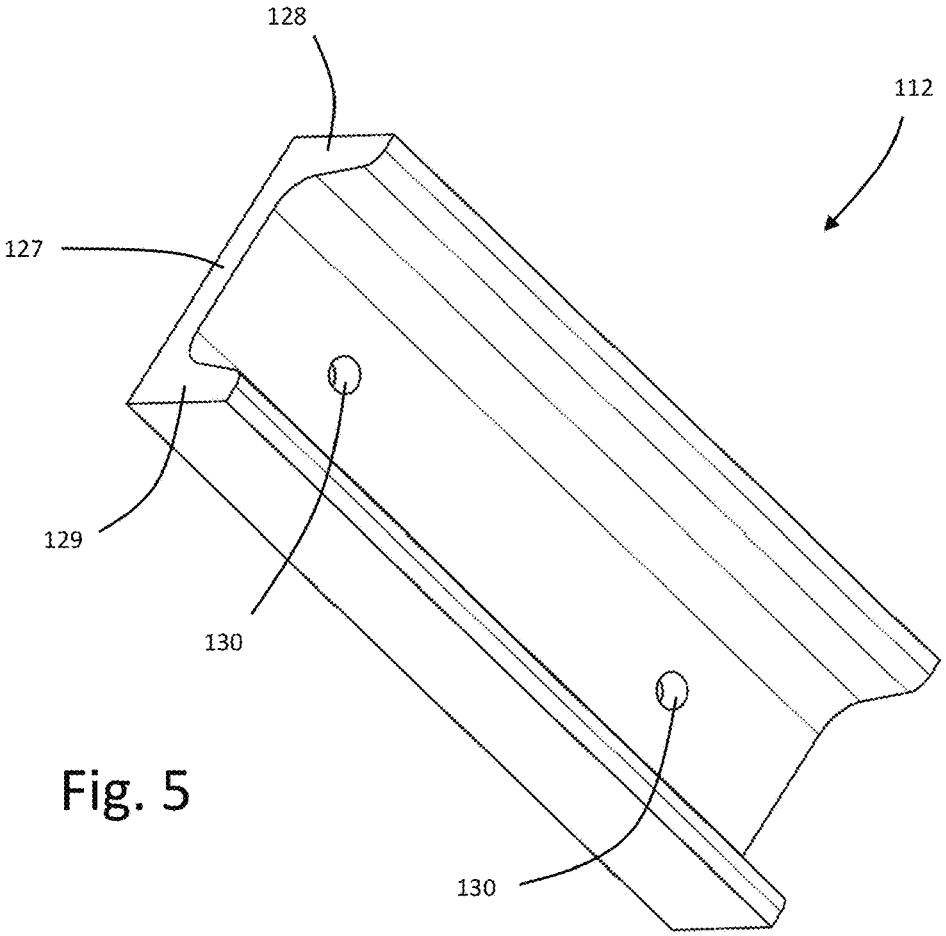
FIG. 5 is a third modular component in accordance with the present disclosure.
Figure 6:
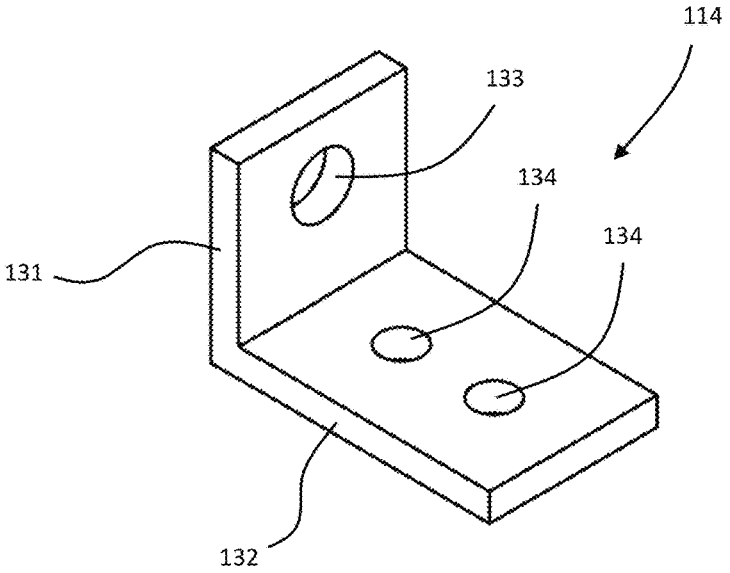
FIG. 6 is a fourth modular component in accordance with the present disclosure.

The pole clamp plate 112 shown in FIG. 5 is an elongate, prismatic component. The cross-section of the plate 112 has a base 127 and two opposing arms 128, 129 providing a "U" shape. At two spaced-apart positions on the base, spaced along the longitudinal axis of the plate, there are provided two fixing holes 130.

Advantageously, the pole clamp plate 112 can be a "plug-n-play" component to the bracket plate 108 and the Back plate 110. Using the pole clamp plate 112 colinearly with a pole, it is ensured that the selected clamp configuration has the required surface contact with the pole so as the friction generated between the pole clamp plate and the pole is adequate to support both the weight and the wind loading of the installed antenna after installation on the mast.

It will be noted that the contact surface area of the pole clamp plate 112 is at least ten times more than that of the prior art collar 27, 29 found on the legacy antenna "support" system, ensuring that the novel support system of the present disclosure can withstand higher weight and wind-load than the legacy solutions.

Angle Section 114

The angle section 114 comprises a first portion 131 and a second portion 132 at right angles to each other. The first portion 131 comprises a bore 133, and the second portion two spaced apart bores 134, one close to the first portion than the other.

Advantageously, the angle section 114 can be a "plug-n-play" component with the bracket plate 108 in order to form the H-type bracket 200 and the J-type bracket 400 (described below). At the H-type bracket 200 configuration on the second portion 132 the two spaced apart bores 134 can be fixed in pairs on the bore set 117 and the bore set 118 of the bracket plate 108 (2×angle section 114 components are needed).

H-Type Bracket 200

The H-type bracket assembly shown in FIGS. 7*a* and 7*b* comprises a bracket plate 108, a back plate 110, two angle sections 114, two clamp bolts 202 (with locking nuts 204) and several screws 206 with nuts 207.

The H-type bracket is used for square section mast members, such as upright member 4 in FIG. 1. The square section mast member in FIGS. 7*a* and 7*b* is also labelled 4, and referring to the right hand side of FIG. 1 is shown installed on the mast 2.

The angle sections 114 are attached to the bracket plate 108 with screws 206 passing through the bores 134 and fixing holes 116 in the first set 117. They are secured with nuts. The angle sections 114 are then attached to the member 4 in order to align the bracket plate 108 on the mast's vertical structural member and ensure the symmetry of the steering unit fixing holes 120, along with the symmetry of the azimuth steering unit locking plate 104. In this way, the installed antenna can be tightly secured, collinearly on the mast's vertical structural member, as such the antenna reflector/backplane cannot be twisted when clamped on the mast.

The back plate 110 is positioned on an opposite side of the member 4 to the bracket plate 108. A first clamping bolt 202 is fed through a clamping hole 119 of the bracket plate and the aligned clamping hole 126 of the back plate. A second clamping bolt 202 is fed through a second clamping hole 119 of the bracket plate and the aligned clamping slot 125 of the back plate. The locking nuts 204 are used to tension the bolts 202 and thereby produce a clamping force on the member 4 to secure the bracket 200 in position. It will be noted that the attachment of the angle sections 114 to the member 4 is merely for alignment purposes, and is not intended to support any load (this is supported by the clamping force/friction of the bracket 200).

The steering and locking unit 100 is attached to the bracket plate 108 by securing fasteners through the spaced-apart fixing holes 150 of the unit 100 and the steering unit fixing holes 120. It should be noted that the attachment of the unit 100 to the plate 108 takes place before the plate 108 is assembled with the rest of the bracket 200 to clamp the member 4. The horizontal length of the azimuth steering and locking unit 100 enables the position of the antenna to be offset the mast.

As such, an antenna of around three meter height and half a meter width can be placed spaced apart from the mast section on the horizontal plane in order to achieve azimuth steering of 120° range and tilt inclination of 20° range (up-tilt or down-tilt) without clashing on the mast structural members.

In this way the novel antenna support system of the present disclosure is simple and fast, and can take place in one discrete phase. In this single installation phase the new antenna support system (H-type bracket configuration) is installed on the antenna along with its azimuth steering units 100 and tilt brackets 26, 28 on the ground.

Because of the ability of the units 100 to be locked into a predetermined angular orientation, the steering angle can be selected and "locked in" before the assembly is taken up the mast to the appropriate height. Once installed, the antenna azimuth alignment is correct. This is clearly desirable due to the small amount of time it takes the riggers to perform such an installation. Smaller times of specialized personnel (like riggers) on tower-top, positively impacts installation costs, revenues (decreased site-down-time), health and safety at work.

The idea of alignment with respect to a "reference frame" was introduced in applicant's earlier application WO2013/171291. This idea can be combined with the embodiments described herein to solve some of the above-mentioned problems with the prior art. In particular, the orientation of the mast member can be measured to a high degree of accuracy. The required steering angle can then be determined to achieve the desired antenna heading. The steering angle can be "locked in" using the steering and locking unit on the ground (pre-assembled with the antenna and bracket 200) before installation. Therefore when the rigger installs the antenna by attaching the bracket 200 as described above, the antenna heading will be correct, eliminating any error. The idea of alignment with respect to a "reference frame" as introduced in applicant's earlier application WO2013/171291 is applied to all mounting brackets disclosed in the present disclosure.

The H-bracket design shown in FIGS. 7*a* and 7*b* can be modified to fit a range of sizes of square section members 4. This can be facilitated by positioning the angle section 114 appropriately. For example, for a larger square section than shown in FIGS. 7*a* and 7*b*, the angle sections 114 can be attached to the bracket plate 108 at positions further towards the edge—i.e. in a different pair of the holes 117, 118. Therefore, a range of square sections—for example 60×60 mm, 70×70 mm, 80×80 mm can be accommodated.

It should be noted that in the present embodiment, a pair of H-type brackets 200 spaced along the mast with respective azimuth steering units 100 weighs less than 10 Kg in total. When replacing the prior art antenna supports 12, 14 and pole 22 the tower-top can be relieved of more than 50 Kgs of unnecessary weight per antenna. This H-type bracket advantage positively impacts the mean time between failure (MTBF) of the tower itself—not to mention that on marginal static cases (especially when RAN technology network upgrades are needed), expensive mast reinforcements can be avoided and $CO_2$ emissions into the environment can be significantly minimized.

E-Type Bracket 300

The E-type bracket is used for angle sections such as the member 301 in FIGS. 8*a* and 8*b*.

The E-type bracket assembly shown in FIGS. 8*a* and 8*b* comprises four bracket plates 108, two outer angle plates 302, two inner angle plates 304, a plurality of attachment screws 306 and two clamping bolts 308 with associated locking nuts 310.

Two of the plates 108 are attached using two spaced-apart outer angle plates 302 (FIG. 8*a*) using screws 306 through the plates 302 and two of the respective first set 117 and second set 118 of fixing holes 116. This forms an outer L-shaped subassembly.

The other two plates 108 are attached using two spaced-apart inner angle plates 304 (FIG. 8*b*) using screws 306 through the plates 302 and two of the respective first set 117 and second set 118 of fixing holes 116. This forms an inner L-shaped subassembly.

The inner and outer subassemblies are positioned either side of the member 301 and clamped together with clamping bolts 308 through the outermost clamping holes 119 of the bracket plates to clamp the member 301.

The steering and locking unit 100 can be attached to the outer bracket plates 108 by securing fasteners through the spaced-apart fixing holes 150 of the unit 100 and the steering unit fixing holes 120. It should be noted that the attachment of the unit 100 to the plate 108 takes place before the plate 108 is assembled with the rest of the bracket 300 to clamp the member 301.

The horizontal length of the azimuth steering and locking unit 100 enables the position of the antenna to be offset the mast. As such, an antenna of around three meter height and half a meter width can be placed spaced apart from the mast section on the horizontal plane in order to achieve azimuth steering of 120° range and tilt inclination of 20° range (up-tilt or down-tilt) without clashing on the mast structural members.

In this way the novel antenna support system of the present disclosure is simple and fast, and can take place in one discrete phase. In this single installation phase the new antenna support system (E-type bracket configuration) is installed on the antenna along with its azimuth steering units 100 and tilt brackets 26, 28 on the ground.

The E-type bracket 300 can be configured to clamp a range of different angle section members 301. In particular the outer angle plates 302 and inner angle plates 304 can be attached to the respective bracket plates 108 via a range of openings of the pluralities of openings provided in those angle plates (each is shown with three pairs of attachment openings).

Some examples of the dimensions of the angle section members that may be accommodated:

| |
|---|
| 140 × 140 × 13 mm |
| 140 × 140 × 15 mm |
| 150 × 150 × 12 mm |
| 150 × 150 × 14 mm |
| 150 × 150 × 15 mm |
| 150 × 150 × 18 mm |
| 160 × 160 × 15 mm |
| 180 × 180 × 16 mm |
| 180 × 180 × 18 mm |
| 200 × 200 × 16 mm |

It should also be noted that steering and locking units 100 and antennas can be attached to each of the outer bracket plates 108 simultaneously. This allows two antennas to be attached to each member 301. So, in the event that the mast is triangular in section (three vertical members), it is possible to attach up to six antennas. In the event that the mast is square in section (four vertical members), it is possible to attach up to eight antennas.

For such a configuration the weight that can be saved from tower-top is over 500 Kgs. Taking into account that more new antennas need to be installed on existing masts with the introduction of i.e. 5G technology and the new frequency spectrum allocations, such weight savings are significant for the improvement of the mast's mean time between failure (MTBF), the reduction of costs involved to mast reinforcements and the environmental benefits the minimized $CO_2$ emissions offer.

J-Type Bracket 400

Figure 9B:
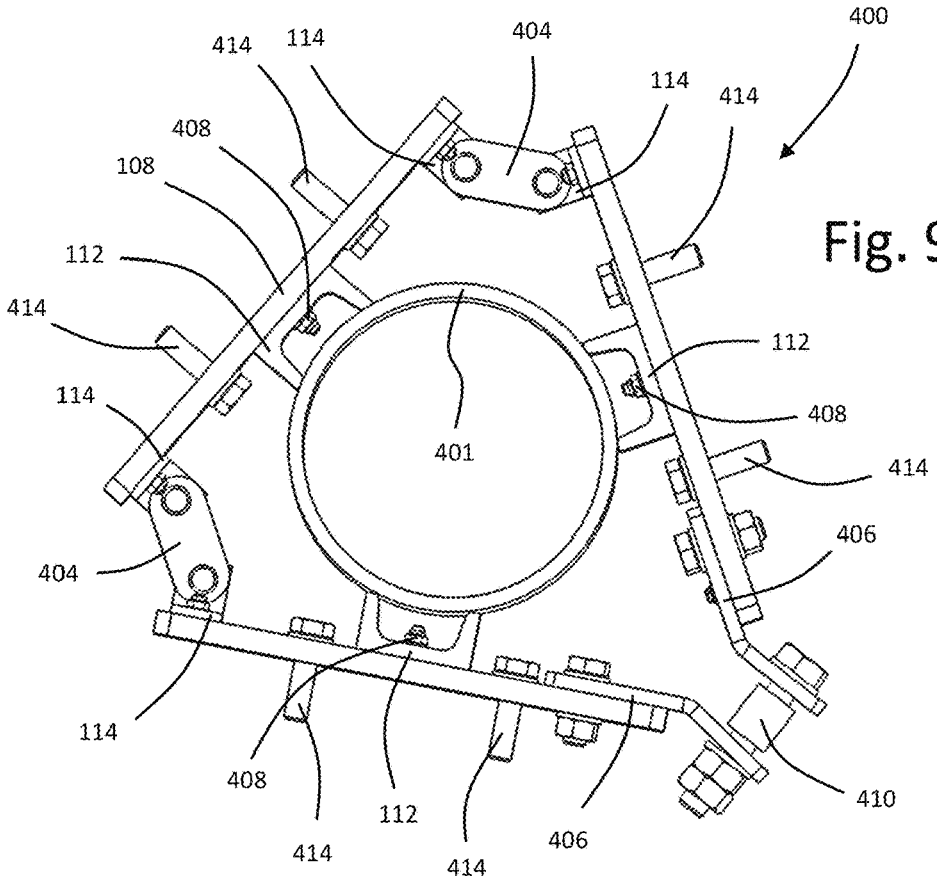
Figure 9C:
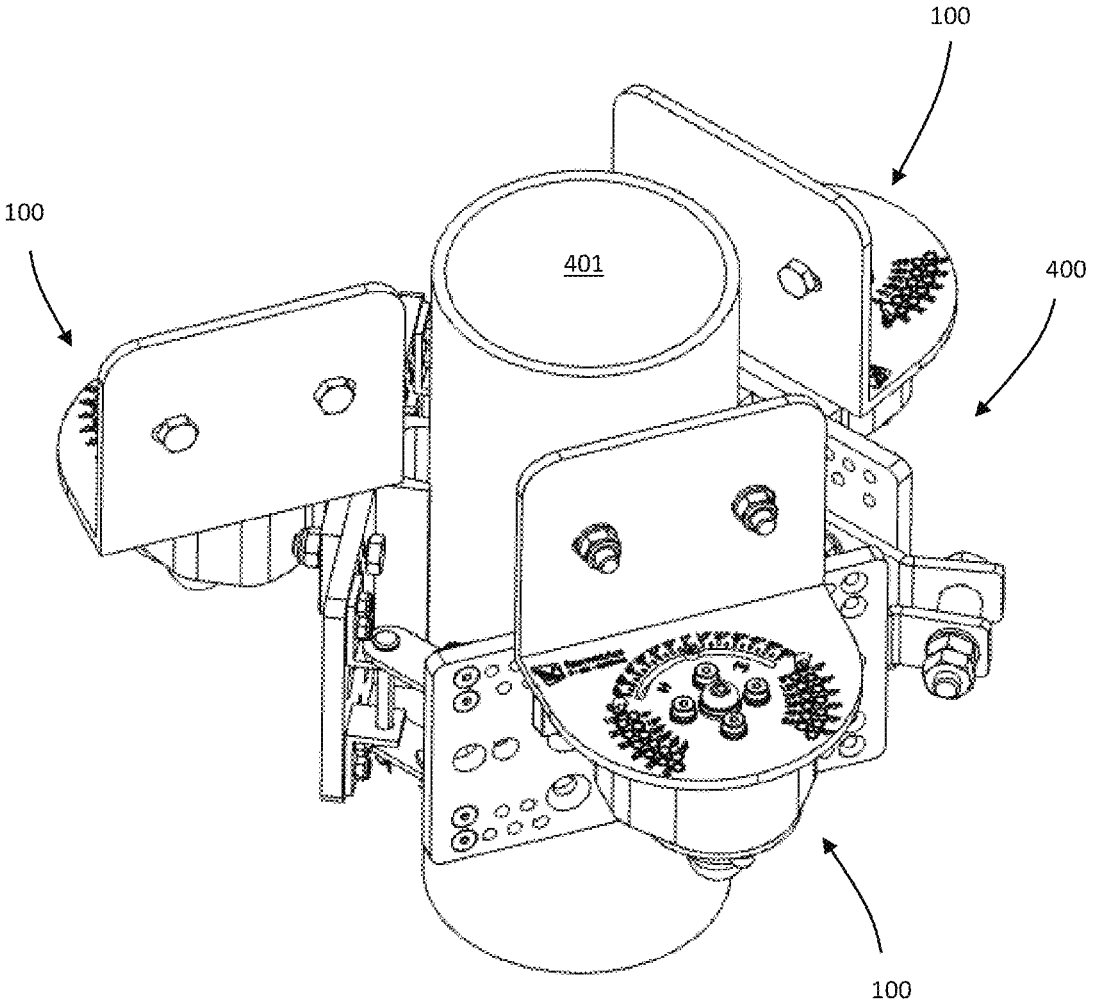

The J-type bracket is used for circular sections such as the member 401 in FIGS. 9*a* to 9*c*.

The J-type bracket assembly shown in FIGS. 9*a* and 9*b* comprises three bracket plates 108, eight angle sections 114, four links 404, two clamp brackets 406, a plurality of attachment screws 408, a clamping bolt 410 with associated locking nuts 412 and three pole clamp plates 112.

The angle sections 114 are attached to one end of two of the brackets 108, and to both ends of the other bracket 108 with screws 408 using the fixing holes 117, 118. The plates are then attached by connecting the angle sections 114 with the links 404 (two extending between each adjacent bracket 108). The links are articulated such that the plates 108 are rotatable relative to one another.

The clamp brackets 406 are attached to the free ends of the arrangement by attachment to the innermost clamping hole 119.

A pole clamp plate 112 is attached to each of the plates 108 via screws 408 engaging the pole clamp plate fixing holes 121 on the plate 108 and the fixing holes 130 on the plate 112.

The arrangement can then be equally spaced "wrapped" around the pole 401, the clamping bolt 410 inserted through the clamp brackets and the locking nuts 412 used to put the bolt 410 in tension to clamp the bracket 400 to the pole 401.

Advantageously, depending on pole 401 diameter i.e. Φ 114, Φ 150, Φ 200, etc, the links 404 can be provided in various lengths in order to secure the J-type bracket to fit the required pole.

The steering and locking unit 100 can be attached to the outer bracket plates 108 by securing fasteners 414 through the spaced-apart fixing holes 150 of the unit 100 and the steering unit fixing holes 120. It should be noted that the attachment of the unit 100 to the plate 108 takes place before the plate 108 is assembled with the rest of the bracket 400 to clamp the member 401.

Taking into account that usually 3 antennas (for a 3-sector site), half a meter wide and with azimuth range freedom of 120 degrees each are to be installed on the pole, the J-type bracket 400 in conjunction with the azimuth steering unit 100 allows the use of poles of very small diameter. Using such poles for the purpose is not only inexpensive but also practical and straightforward to implement.

It is often desirable to exchange old antennas with more modern antennas (typically larger in size) on monopole rooftop masts. Such base stations are typically covered with camouflage and/or a radome. The J-type bracket deployment according to the present disclosure can make it possible for the same camouflage to be used, instead of having to swap to a larger diameter one. Ordinarily, the external radius of the new antennas combined with the prior art antenna "support" would extend the antenna outer surface radially outwardly. As such it would clash on the (fixed) camouflage. By swapping the prior art antenna "support" for the novel one proposed herein, the external radius of the new antennas is minimised (at the same time offering the required azimuth steering capability). This is highly desirable not only due to the costs involved on such activity, but also to retain the initial aesthetic reasons the camouflage was selected from the beginning.

Special azimuth steering units could be used for the purpose, such as the ones shown on FIG. 9*c*.

It should be noted that a pair of J-type bracket type 400 spaced along the mast weighs less than 10 Kg in total, such as when comparing to the prior art antenna supports 12, 14 and pole 22 the tower-top can be relieved from more than 170 kgs of unnecessary weight per three antennas installed. This J-type bracket advantage positively impacts the mean time between failure (MTBF) of the pole itself—not to mention that on marginal static cases (especially when RAN technology network upgrades are needed), expensive mast reinforcements can be avoided and $CO_2$ emissions into the environment can be significantly minimized.

P-Type Bracket 500

Figure 10C:
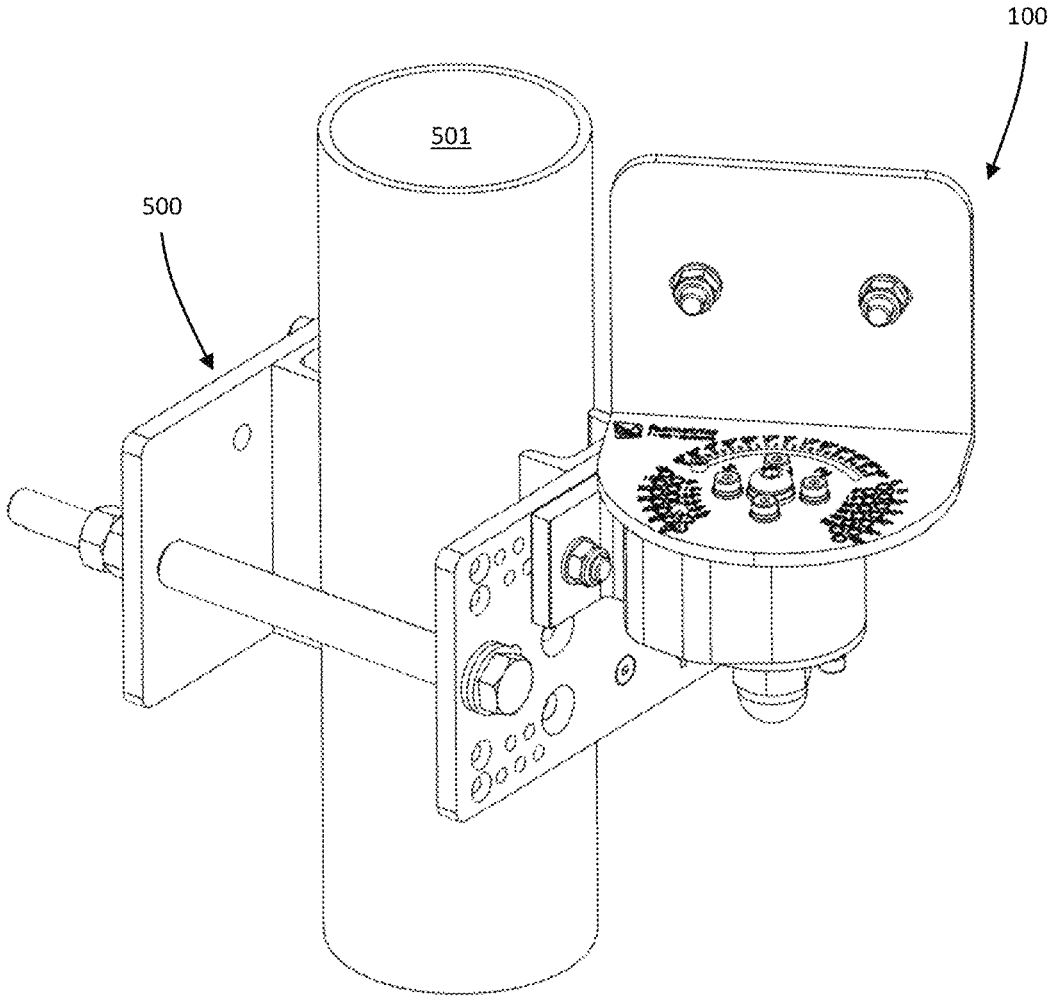

The P-type bracket assembly 500 shown in FIGS. 10*a* to 10*c* comprises a bracket plate 108, a back plate 110, two pole clamp plates 112, and two clamp bolts 502 (with locking nuts 504).

The P-type bracket is used for circle section mast members, such as pole member 501.

A pole clamp plate 112 is attached to each of the plates 108, 110 via screws 506 engaging the pole clamp plate fixing holes 121, 124 on the plates 108, 100 respectively and the fixing holes 130 on the plates 112.

The back plate 110 is positioned on an opposite side of the member 4 to the bracket plate 108. A first clamping bolt 502 is fed through a clamping hole 119 of the bracket plate and the aligned clamping hole 126 of the back plate. A second clamping bolt 502 is fed through a second clamping hole 119 of the bracket plate and the aligned clamping slot 125 of the back plate. The locking nuts 504 are used to tension the bolts 502 and thereby produce a clamping force on the member 501 to secure the bracket 500 in position.

The steering and locking unit 100 is attached to the bracket plate 108 by securing fasteners through the spaced-apart fixing holes 150 of the unit 100 and the steering unit fixing holes 120. It should be noted that the attachment of the unit 100 to the plate 108 takes place before the plate 108 is assembled with the rest of the bracket 200 to clamp the member 501. The installed unit 100 is shown in FIG. 10*c*.

P-type brackets are an option for installation of the azimuth steering units 100, when the user may not want to replace the legacy antenna "support". The azimuth steering functionality of the unit 100 can be provided on the poles of legacy antenna "supports".

W-Type Bracket 600

The W-type bracket is for installation of an antenna on a wall. The bracket plate 100 can be attached to a wall via screws 602 through the holes 119, and wall plugs 604. The steering and locking unit is attached as described above.

Spacers 700, 700',800

Figure 12:
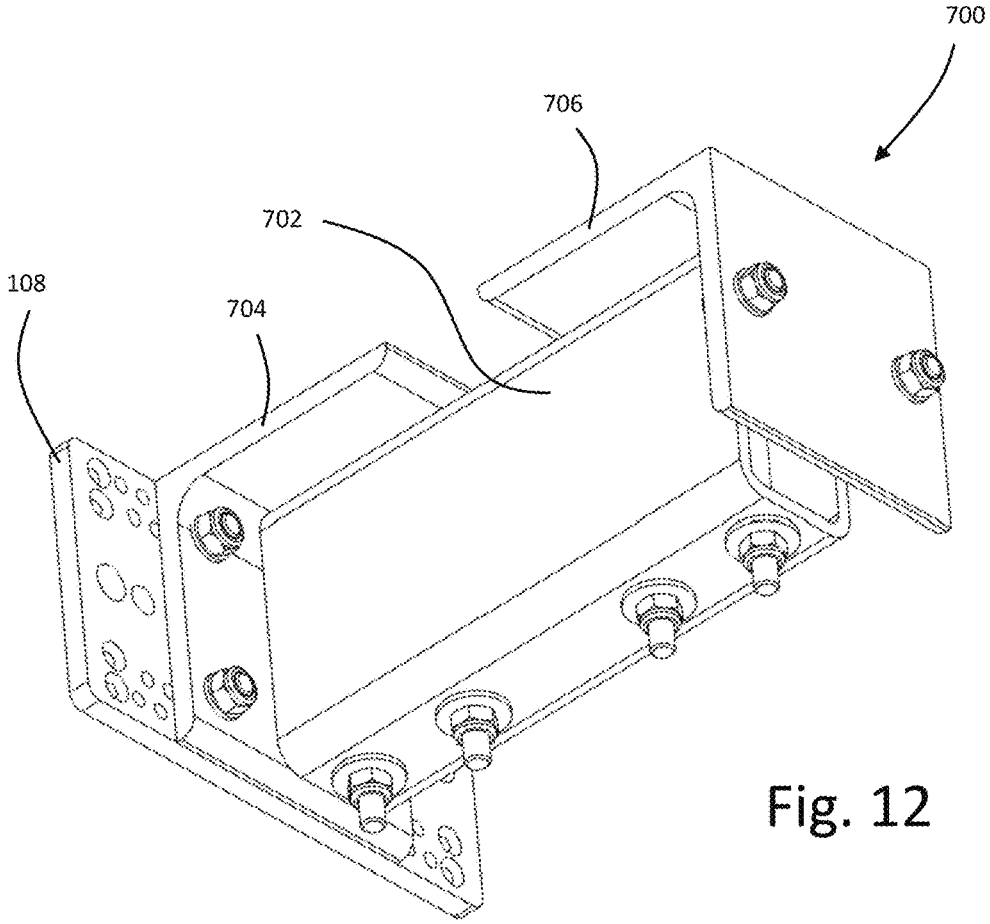
FIG. 12 is a perspective view of a first spacer for use with the systems and methods of the present disclosure.

Referring to FIG. 12, a spacer 700 is shown for use with any of the above brackets. The spacer 700 comprises a tubular section 702 having a first angled plate 704 at a first end and a second angled plate 706 at a second end. The angled plates 702, 704 are welded to the tubular section 702. The spacer 700 can be used to increase the distance from the mast member to the antenna, if required (e.g. for range of movement).

Figure 13:
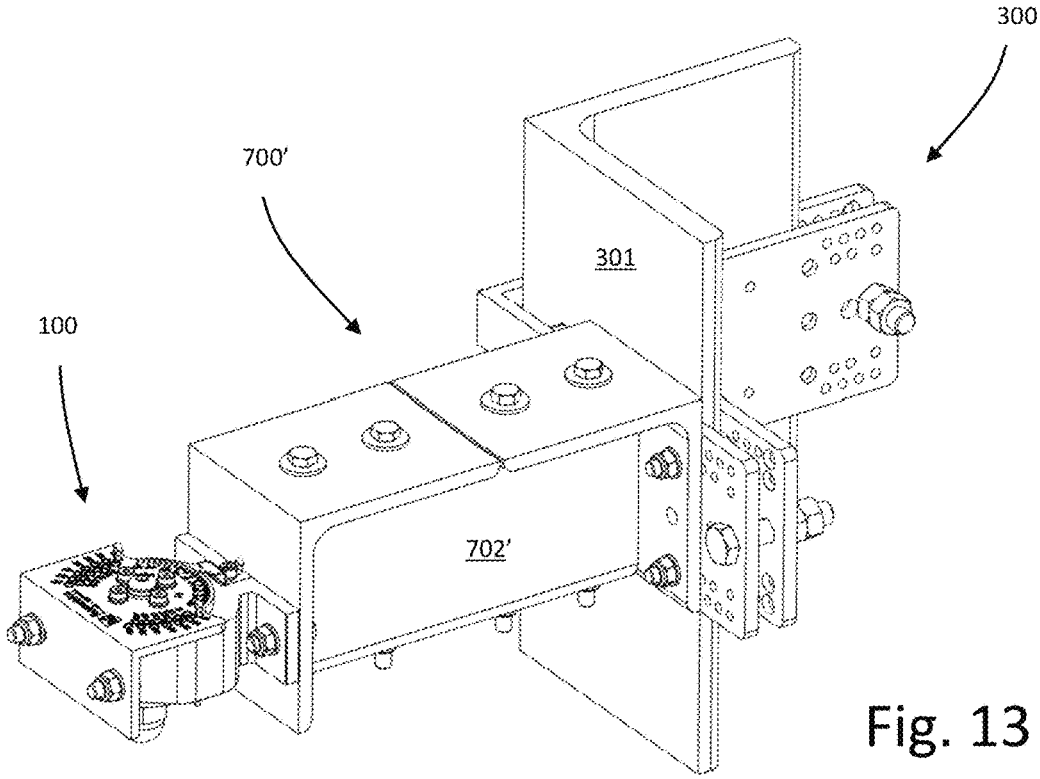
FIG. 13 is a perspective view of a second spacer for use with the system and methods of the present disclosure.

Referring to FIG. 13, a spacer 700' is shown installed between the steering unit 100 and bracket 300. The spacer 700' is similar to the spacer 700, but the tubular section 702' is shorter than the tubular section 702 thus providing slightly less spacing from the mast member 301 to the antenna attached to the steering unit 100.

Figure 14:
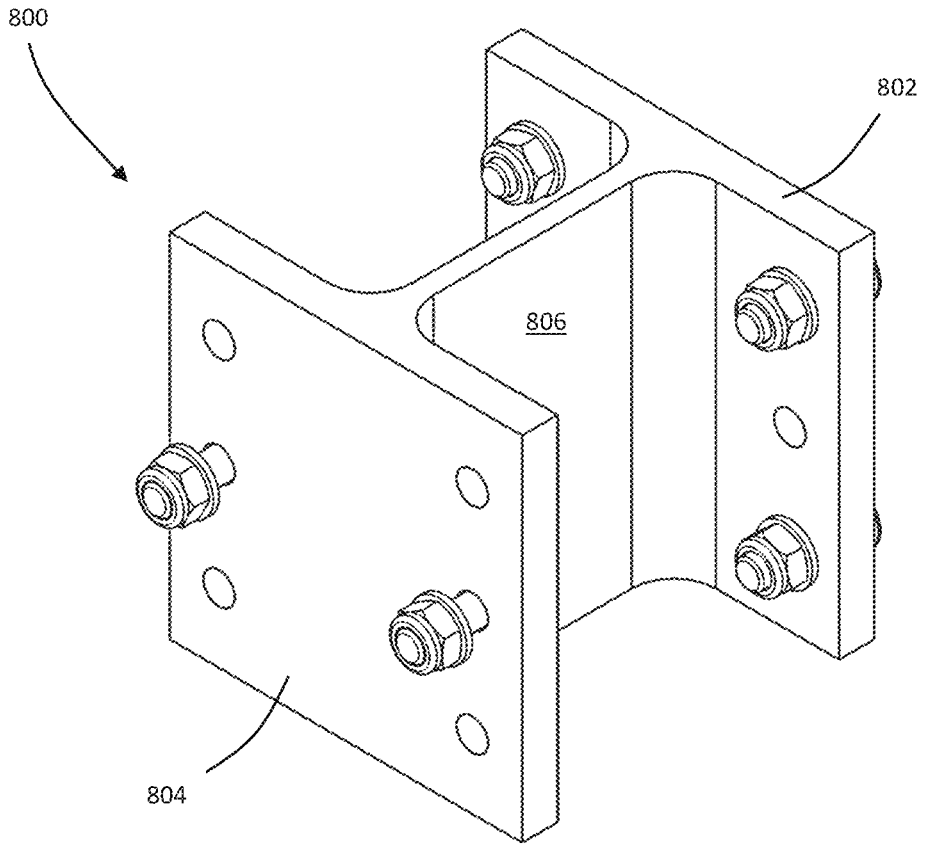
FIG. 14 is a perspective view of a third spacer for use with the systems and methods of the present disclosure.

Referring to FIG. 14, a simpler fixed-length spacer 800 is shown. The spacer 800 is generally I-beam shaped with a flange 702 at a first end for attachment to one of the above brackets, and a flange 704 at a second end for attaching the steering unit 100. A rib 706 spans the spaced-apart flanges 702, 704.

Advantageously, when deploying antennas of high lengths and widths, where brackets need to be placed positioned far from the mast section on the horizontal plane, to achieve azimuth steering of 120 degree range and tilt inclination of 20 degree range (up-tilt or down-tilt) without clashing on the mast structural members, spacers can be of assistance.

Apart from the horizontal spacers 700, 700' and 800, vertical spacers (not shown) may be also of use. Vertical spacers may extend vertically from the azimuth steering unit 100 in order to displace the antenna mounting points if needed. Since, the mast vertical structural members have limited available surface area for antenna mounting (due to the fact that the horizontal and diagonal cross-members are fixed to them in close patterns, and cannot be removed), as well as the fact that the antenna's vertical spacing of its top and bottom mounting points are fixed in position (which makes it very likely to coincide with the horizontal and diagonal cross-member mounting points on the mast vertical structural members), vertical spacers may be deployed to tackle the problem.

Advantageously, using the vertical spacer on J-type bracket, one may use antennas of different length i.e. one antenna of 2.6 meters and 2 antennas of 2 meters length by using the vertical spacer configurations on the bottom azimuth steering units.

Kit

In use, the present disclosure comprises a kit of parts comprising several components common to at least two of the above bracket assemblies (e.g. the plate 108). This provides the installer with the ability to select a combination of parts from the kit based on the type of member the antenna needs to be attached to.

After removal of the legacy support, the universal clamp arrangement of the present disclosure can be constructed from the kit, assembled with the steering and locking mechanism and clamped to the mast. Two such assemblies are configured in a spaced apart vertical relationship, with the axes of the steering units aligned on the azimuth steering axis Z' (FIG. 1).

Use

The present disclosure can be used on new antenna installations, but is well-suited to replacement of existing legacy installations. Referring to FIG. 1, the known system on the left hand side can be replaced with the new system (using the clamps of the present invention) on the right hand side. This alleviates the identified problems with the prior art.

While various embodiments of the components, systems, and methods hereof have been described in considerable detail, the embodiments are merely offered by way of non-limiting examples. Many variations and modifications of the embodiments described herein will be apparent to one of ordinary skill in the art in light of the present disclosure. It will therefore be understood by those skilled in the art that various changes and modifications may be made, and equivalents may be substituted for elements thereof, without departing from the scope of the disclosure. Indeed, this disclosure is not intended to be exhaustive or too limiting. The scope of the disclosure is to be defined by the appended claims, and by their equivalents.

Further, in describing representative embodiments, the disclosure may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of any steps disclosed herein should not be construed as limitations on the claims. In addition, the claims directed to a method and/or process should not be limited to the performance of their steps in the order written, and one skilled in the art can readily appreciate that the sequence may be varied and still remain within the spirit and scope of the present disclosure.

It is therefore intended that this description and the appended claims will encompass, all modifications and changes apparent to those of ordinary skill in the art based on this disclosure.

The invention claimed is:

1. A cellular antenna support system for attachment of a cellular communications antenna to a cellular antenna mast member of a mast structure comprising:

a universal clamp kit having:

a first and a second universal clamp plate, the first universal clamp plate having a mounting face;

a first set of components for adapting the universal clamp plates to form a first clamp to clamp around the entire periphery of a first shape of cellular antenna mast member section to generate friction with the first shape of cellular antenna mast member section sufficient to support an antenna; and, a second set of components for adapting the universal clamp plates to form a second clamp to clamp around the entire periphery of a second shape of cellular antenna mast member section to generate friction with the second shape of cellular antenna mast section sufficient to support an antenna;

wherein at least one of the first and second shape of cellular antenna mast member section is a substantially L-shaped angle section; and, an azimuth steering unit configured for attachment to the first universal clamp plate, the azimuth steering unit comprising a rotational joint having an azimuth steering axis, the azimuth steering unit being mounted on the mounting face of the first universal clamp plate.

2. The cellular antenna support system according to claim 1, wherein the first and second shapes of antenna mast member section are selected from: a square section, a planar section, and a circular section.

3. A cellular antenna support system according to claim 2, wherein the azimuth steering unit is attached to the first clamp plate via at least some of the plurality of openings.

4. The cellular antenna support system according to claim 1, wherein at least the first clamp engages with the first shape of antenna mast member section such that the first clamp cannot be rotated relative to the first shape of antenna mast section.

5. The cellular antenna support system according to claim 1, wherein the first universal clamp plate is substantially flat and attachable to a wall.

6. The cellular antenna support system according to claim 1, wherein the rotational joint comprises a rolling element bearing.

7. The cellular antenna support system according to claim 1, wherein the azimuth steering unit comprises a locking mechanism configured to mechanically lock the steering unit at a predetermined angle.

8. The cellular antenna support system according to claim 7, wherein the locking mechanism comprises a locking plate comprising a plurality of openings, and a locking member engageable with each of the plurality of openings to thereby lock the steering unit.

9. A cellular antenna support system according to claim 1, comprising a tilt bracket between the azimuth steering unit and the antenna.

10. A cellular antenna support system according to claim 1, wherein the first clamp comprises:

an outer L-shaped subassembly comprising at least one of the universal clamp plates; and an inner L-shaped subassembly.

11. A cellular antenna support system according to claim 1, wherein the first clamp plate comprises a body with a plurality of openings through a thickness thereof.

12. A cellular antenna support system according to claim 1, wherein the mounting face is parallel the mast member.

13. A cellular antenna support system according to claim 1, wherein the azimuth steering axis is on the opposite side of the first mounting member to the mast member.

14. A method of installing a cellular antenna support system on a cellular antenna mast comprising the steps of:

providing a cellular mast, the mast comprising a plurality of mast members;

providing a universal clamp kit having:

a first and a second universal clamp plate, the first universal clamp plate having a mounting face;

a first set of components for adapting the universal clamp plates to form a first clamp to clamp a first shape of cellular antenna mast member section, wherein the first shape is substantially L-shaped; and, a second set of components for adapting the universal clamp plates to form a second clamp to clamp a second shape of cellular antenna mast member section;

providing an azimuth steering unit;

selecting one of the first and second sets of components;

assembling the first or second clamp dependent upon the selected set of components;

attaching the azimuth steering unit to one of the first and second universal clamp plates;

clamping one of the plurality of mast members with the first or second clamp; and, attaching a cellular antenna to the azimuth steering unit.

15. A method of modifying an assembly of a cellular antenna mast and cellular antenna, the assembly comprising:

an antenna mast comprising a mast member having a mast member cross-section comprising one of a square, rectangular or angle section;

a support bracket attached to the mast member at a first end, and to a pole at a second end;

a first antenna attached to the pole so as to be rotatable with respect to the pole in at least one of a vertical and horizontal axis;

the method comprising the steps of:

removing the support bracket and the antenna from the mast;

providing a mast clamp configured to clamp the mast member between at least a first and second part of the mast clamp, wherein the mast clamp engages the mast member cross-section such that the first clamp cannot be rotated relative to the first shape of antenna mast section;

providing an azimuth steering unit comprising a rotational joint having an azimuth steering axis;

attaching the steering unit to the mounting face of the first universal clamp plate;

clamping the mast member with the mast clamp; and attaching one of the first antenna and a second antenna to the steering and locking unit.

16. The method of modifying an assembly of a cellular antenna mast and cellular antenna according to claim 15, comprising the steps of:

assembling the one of the first antenna and a second antenna, azimuth steering unit and mast clamp before clamping the mast member with the mast clamp.

17. The method of modifying an assembly of a cellular antenna mast and cellular antenna according to claim 16, comprising the step of:

locking the steering unit before clamping the mast member with the mast clamp.

18. The method of modifying an assembly of a cellular antenna mast and cellular antenna according to claim 17, comprising the steps of:

measuring the orientation of the mast member;

identifying a desired antenna heading;

calculating the required azimuth steering angle of the steering unit to achieve the desired antenna heading; and locking the steering unit at the required azimuth steering angle before clamping the mast member with the mast clamp.

19. The method of modifying an assembly of a cellular antenna mast and cellular antenna according to claim 18, wherein the step of locking takes place before a step of elevating the antenna to the required height.

20. The method of modifying an assembly of a cellular antenna mast and cellular antenna according to claim 15, wherein the assembly comprises two spaced-apart support brackets, and wherein the pole extends between the support brackets.

21. The method of modifying an assembly of a cellular antenna mast and cellular antenna according to claim 15, wherein the method comprises:

providing two mast clamps;

providing two azimuth steering units, attached to respective mast clamps;

attaching the first or a second antenna to the mast at two spaced apart positions using the two mast clamps such that the azimuth steering axes of the steering units are aligned.

* * * * *